US005492272A

United States Patent [19]

Fewer

[11] Patent Number: 5,492,272

[45] Date of Patent: Feb. 20, 1996

[54] MAIL SLOT RECEIVING DEVICE

[76] Inventor: Brian R. Fewer, 731 41st Ave., San Francisco, Calif. 94121

[21] Appl. No.: 342,165

[22] Filed: Nov. 18, 1994

Related U.S. Application Data

[63] Continuation-in-part of Ser. No. 22,632, May 9, 1994, which is a continuation of Ser. No. 7,812, May 3, 1993, abandoned.

[51] Int. Cl.[6] ..... A47G 29/12

[52] U.S. Cl. ..... 232/19; 232/33

[58] Field of Search ..... 232/33, 19, 23, 232/17

[56] References Cited

U.S. PATENT DOCUMENTS

| | | | |
|---|---|---|---|
| 449,593 | 3/1891 | Scott | 232/19 |
| 454,298 | 6/1891 | Shemp | 232/19 |
| 782,229 | 2/1905 | Field | 232/19 |
| 2,829,820 | 4/1958 | Evers | 232/33 |
| 4,069,965 | 1/1978 | Maddox | 232/19 |
| 4,776,512 | 10/1988 | Moore . | |
| 5,368,226 | 11/1994 | Franceschino | 232/33 |

*Primary Examiner*—Flemming Saether

[57] ABSTRACT

A mail slot receiving device for capturing and retaining mail positioned through a mail slot. The inventive device includes a mounting assembly securable beneath a mail slot. A flexible receiving assembly is coupled to the mounting assembly for receiving mail positioned through the mail slot. The receiving assembly will flexibly deform to retain mail therewithin during movement of the device such as occurs when the device is secured to a garage door.

3 Claims, 3 Drawing Sheets

MAIL SLOT RECEIVING DEVICE

RELATED APPLICATION

This application is a continuation-in-part of copending application, Ser. No. 29/022,632, filed May 9, 1994, which, in turn, is a continuation of prior application Ser. No. 29/007,812, filed May 3, 1993, now abandoned.

BACKGROUND OF THE INVENTION

1. Field of the Invention

The present invention relates to receptacle structures and more particularly pertains to a mail slot receiving device for capturing and retaining mail positioned through a mail slot.

2. Description of the Prior Art

The use of receptacle structures is known in the prior art. More specifically, receptacle structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art receptacle structures include U.S. Pat. No. 4,826,075; U.S. Pat. No. 4,776,512; U.S. Pat. No. 4,694,503; U.S. Pat. No. 4,069,965; and U.S. Pat. No. 3,653,620.

While these devices fulfill their respective, particular objectives and requirements, the aforementioned patents do not disclose a mail slot receiving device for capturing and retaining mail positioned through a mail slot which includes a mounting assembly securable beneath a mail slot, and a flexible receiving assembly coupled to the mounting assembly for receiving mail positioned through the mail slot, wherein the receiving assembly will flexibly deform to retain mail therewithin during movement of the device such as occurs when secured to a garage door.

In these respects, the mail slot receiving device according to the present invention substantially departs from the conventional concepts and designs of the prior art, and in so doing provides an apparatus primarily developed for the purpose of capturing and retaining mail positioned through a mail slot.

SUMMARY OF THE INVENTION

In view of the foregoing disadvantages inherent in the known types of receptacle structures now present in the prior art, the present invention provides a new mail slot receiving device construction wherein the same can be utilized for capturing and retaining mail positioned through a mail slot. As such, the general purpose of the present invention, which will be described subsequently in greater detail, is to provide a new mail slot receiving device apparatus and method which has many of the advantages of the receptacle structures mentioned heretofore and many novel features that result in a mail slot receiving device which is not anticipated, rendered obvious, suggested, or even implied by any of the prior art receptacle structures, either alone or in any combination thereof.

To attain this, the present invention generally comprises a mail slot receiving device for capturing and retaining mail positioned through a mail slot. The inventive device includes a mounting assembly securable beneath a mail slot. A flexible receiving assembly is coupled to the mounting assembly for receiving mail positioned through the mail slot.

The receiving assembly will flexibly deform to retain mail therewithin during movement of the device such as occurs when the device is secured to a garage door.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mail slot receiving device apparatus and method which has many of the advantages of the receptacle structures mentioned heretofore and many novel features that result in a mail slot receiving device which is not anticipated, rendered obvious, suggested, or even implied by any of the prior art receptacle structures, either alone or in any combination thereof.

It is another object of the present invention to provide a new mail slot receiving device which may be easily and efficiently manufactured and marketed.

It is a further object of the present invention to provide a new mail slot receiving device which is of a durable and reliable construction.

An even further object of the present invention is to provide a new mail slot receiving device which is susceptible of a low cost of manufacture with regard to both materials and labor, and which accordingly is then susceptible of low prices of sale to the consuming public, thereby making such mail slot receiving devices economically available to the buying public.

Still yet another object of the present invention is to provide a new mail slot receiving device which provides in the apparatuses and methods of the prior art some of the advantages thereof, while simultaneously overcoming some of the disadvantages normally associated therewith.

Still another object of the present invention is to provide a new mail slot receiving device for capturing and retaining mail positioned through a mail slot.

Yet another object of the present invention is to provide a new mail slot receiving device which includes a mounting assembly securable beneath a mail slot, and a flexible receiving assembly coupled to the mounting assembly for receiving mail positioned through the mail slot.

Even still another object of the present invention is to provide a new mail slot receiving device wherein the receiving assembly will flexibly deform to retain mail therewithin during movement of the device such as occurs when secured to a garage door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
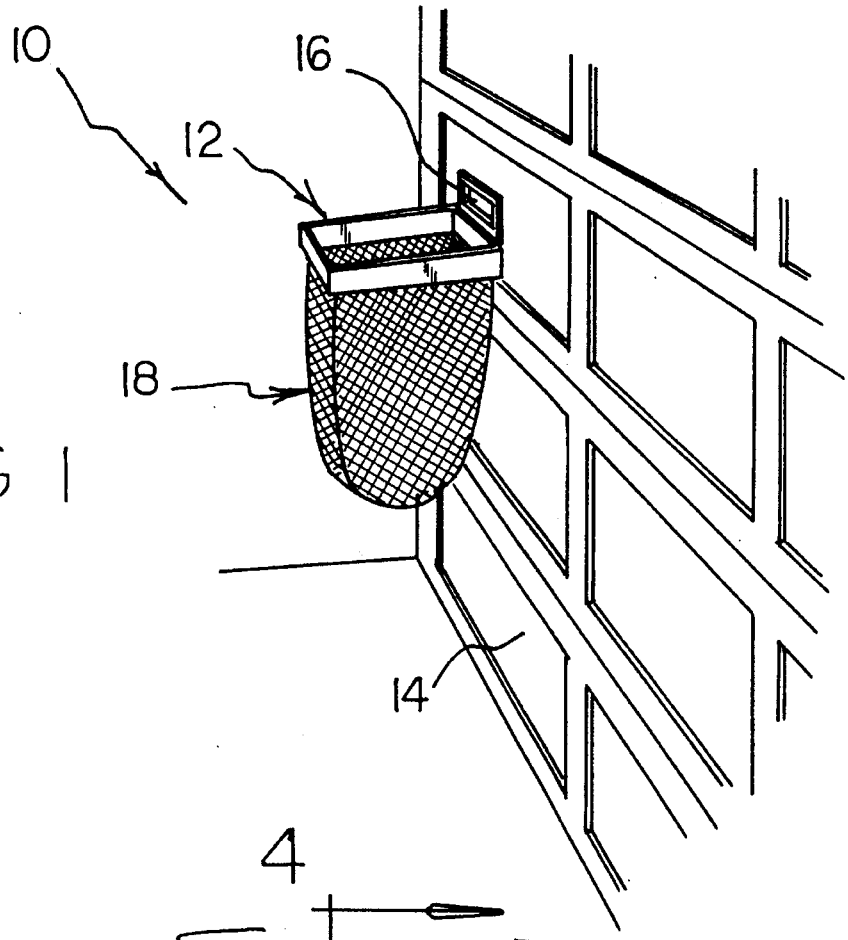
FIG. 1 is an isometric illustration of a mail slot receiving device according to the present invention in use.
Figure 2:
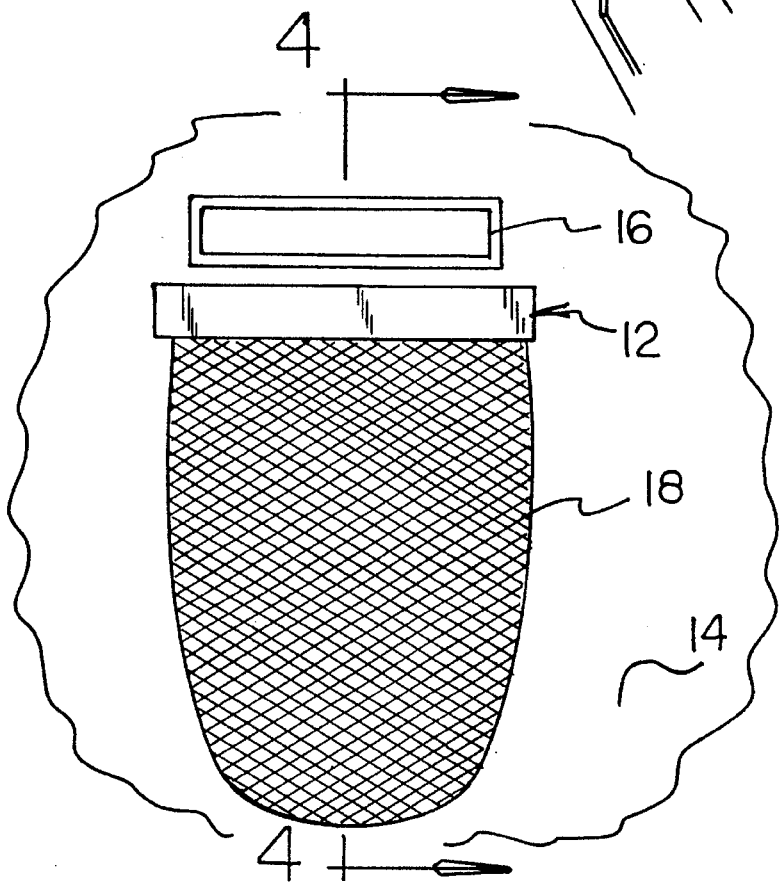
FIG. 2 is an enlarged front elevation view of the invention.

With reference now to the drawings, and in particular to FIGS. 1–6 thereof, a new mail slot receiving device embodying the principles and concepts of the present invention and generally designated by the reference numeral 10 will be described.

More specifically, it will be noted that the mail slot receiving device 10 comprises a mounting means 12 for securing to a support structure, such as the garage door 14 illustrated in the figures, proximal to a mail slot 16 extending through the support structure. A flexible receiving means 18 is coupled to the mounting means 12 for receiving mail positioned through the mail slot 16 to retain the mail relative to the support structure 14.

Figure 3:
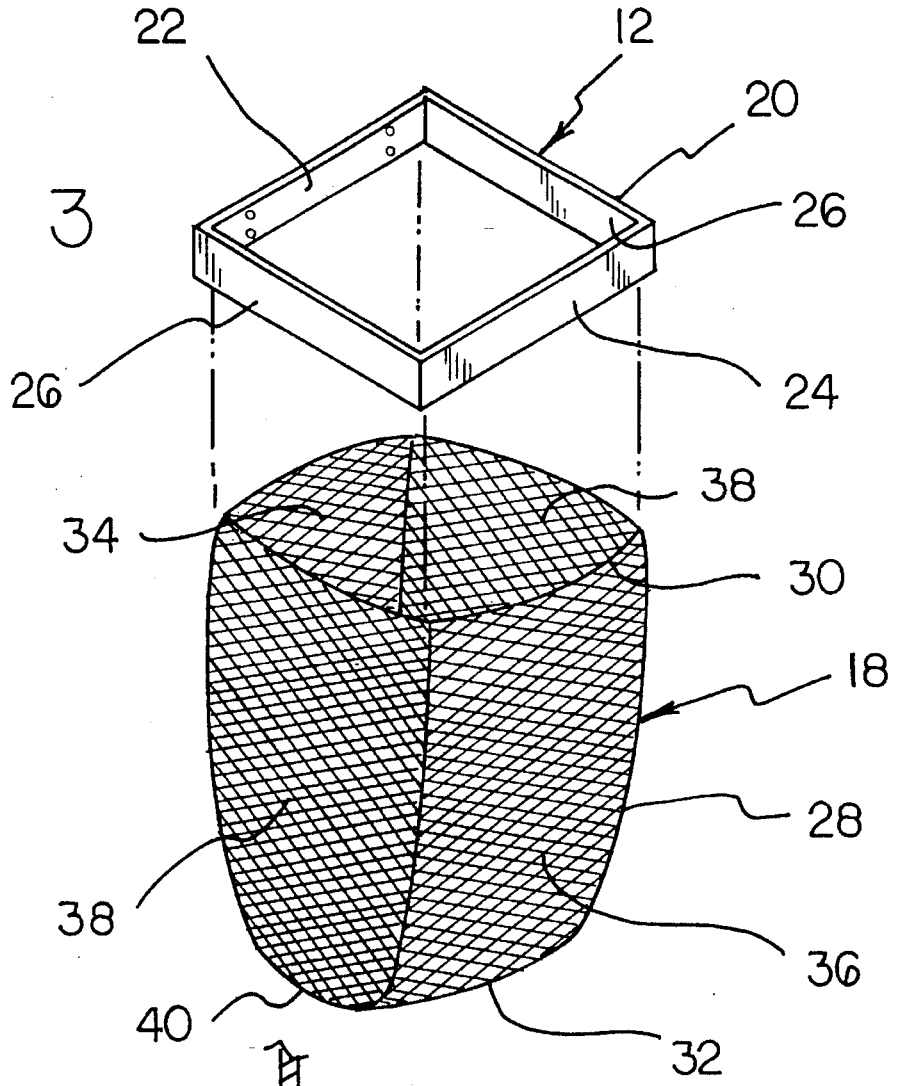
FIG. 3 is an exploded isometric illustration of the invention.
Figure 4:
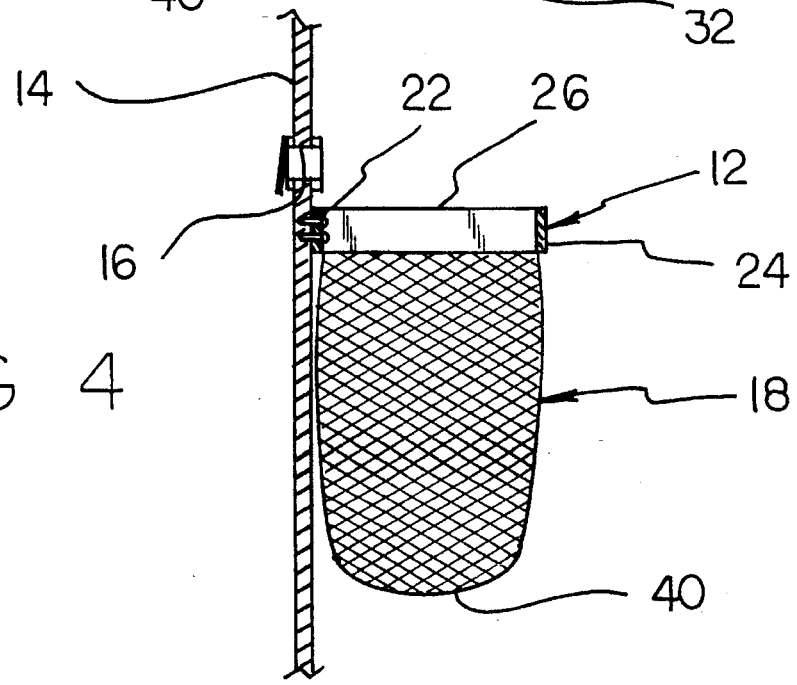
FIG. 4 is a cross sectional view taken along line 4—4 of FIG. 2.

As best illustrated in FIGS. 3 and 4, it can be shown that the mounting means 12 according to the present invention 10 preferably comprises a substantially rectangular frame 20. The frame 20 is constructed of an inner frame member 22 spaced from and oriented parallel to an outer frame member 24 by a pair of lateral frame members 26 extending substantially orthogonally between respectively opposed pairs of ends of the inner and outer frame members to define the rectangular shape of the frame 20. Such coupling of the frame members 22–26 together can be accomplished through the use of suitable bracketry, dovetail joints, adhesives, and mechanical fastening means in a conventional manner. Regardless of the means of coupling of the frame members together, the lateral frame members 26 must be fixed so as to extend from the inner frame member 22 substantially as shown in the figures. The inner frame member 22 can thus be secured to the support structure, i.e. the garage door 14, by mechanical interference or threaded fasteners directed therethrough to support the frame 20 relative to the garage door such that mail positioned through the mail slot of thereof will be received through the frame.

With continuing reference to FIGS. 3 and 4, it can be shown that the flexible receiving means 18 according to the present invention 10 preferably comprises a mesh bag 28 having an open upper end 30 secured about a perimeter of the frame 20 of the mounting means 12, and a closed lower end 32 supporting mail positioned therein. The mesh bag 28 can be attached to the perimeter of the frame 20 by mechanical fasteners such as staples or the like, by suitable adhesives, or by a wrapping of a portion thereof about the frame and securing the portion to the remainder of the mesh bag with stitching. The mesh bag, as shown in FIG. 3, includes an inner mesh web 34 spaced from an outer mesh web 36, with a pair of lateral mesh webs 38 being coupled to respectively opposed pairs of edges of the inner and outer mesh webs to define the mesh bag 28. The mesh webs 34–38 can be coupled together at the closed lower end 32 of the mesh bag 28, or alternatively, the mesh bag 28 can include a transverse bottom mesh web 40 extending between the inner, outer, and lateral mesh webs 34–38. The bottom mesh web 40 is preferably included in the construction of the mesh bag 28 such that mail positioned therein will reside flatly upon the bottom mesh web 40 to maintain the mail in an organized orientation.

Figure 5:
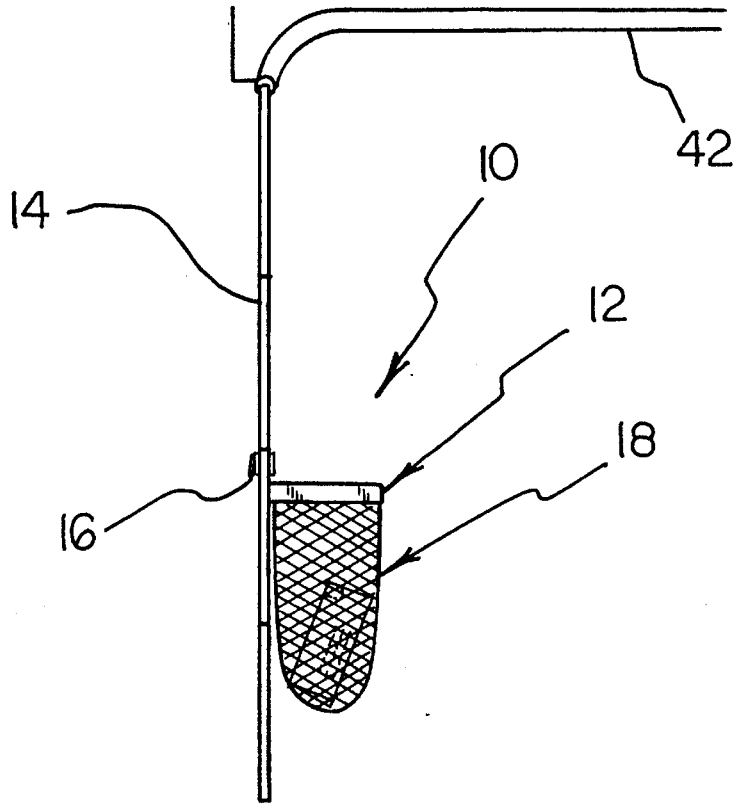
FIG. 5 is a side elevation view of the invention coupled to a garage door in a first position.
Figure 6:
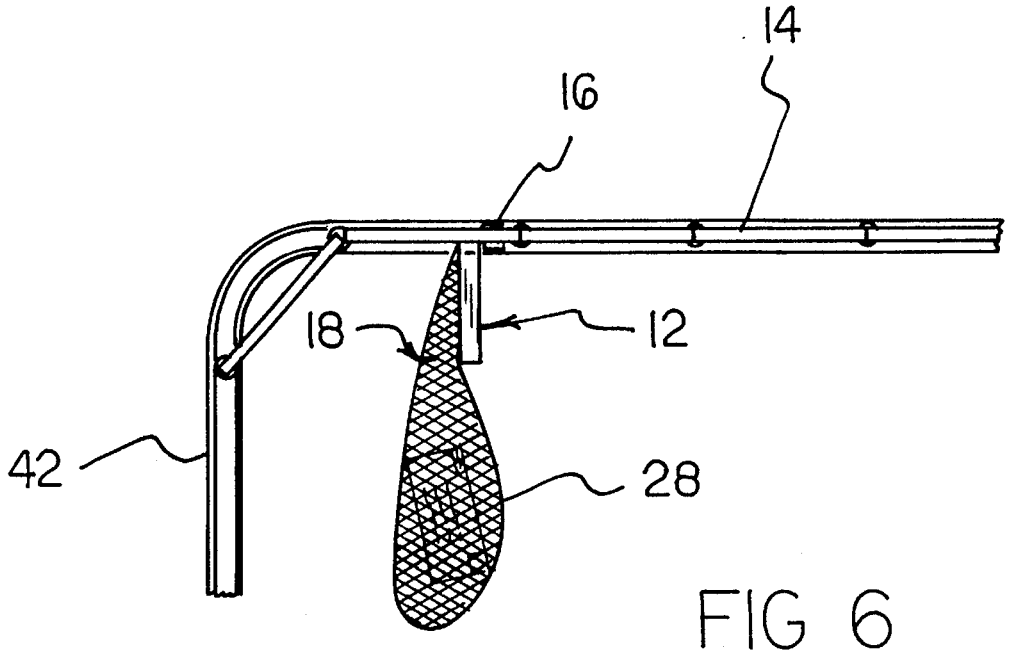
FIG. 6 is a side elevation view of the invention coupled to the garage door in a second position.

Referring now to FIGS. 5 and 6, the present invention 10 is shown to be particularly useful in combination with a garage door 14 having a mail slot 16 directed therethrough and being slidably mounted on a track 42 so as to translate from a first position wherein the garage door is substantially vertically oriented (FIG. 5) to a second position wherein the garage door is substantially horizontally oriented (FIG. 6). The present invention 10, when secured to the garage door 14 beneath the mail slot 16 thereof, will receive mail within the mesh bag 28 of the flexible receiving means 18 when the garage door 14 is in the first position. When the garage door 14 is raised into the second position, as shown in FIG. 6, the mesh bag 28 is permitted to swing downwardly relative to the mounting means 12 under an influence of gravity. Such movement of the mesh bag 28 relative to the mounting means 12 precludes a gravitationally induced egress of the mail from the receiving means 18 when the garage door 14 is in the second or raised position shown in FIG. 6. Thus, when utilized in combination with a garage door 14, it is necessary that the receiving means 18 be flexible relative to the mounting means 12.

In use, the mail slot receiving device 10 according to the present invention can be easily installed to a support structure proximal to a mail slot such that mail positioned therethrough is received and maintained in an orderly fashion for retrieval by an individual. The present invention, when utilized in combination with a garage door 14, substantially eliminates the problem of mail positioned through the mail slot of the garage door landing on the floor of the garage and becoming soiled. Further, the device permits an individual to remotely raise the garage door and drive into the garage without driving over mail positioned on the floor of the garage. Lastly, the flexible nature of the receiving means 18 ensures that the mail will be retained therewithin during opening and closing of the garage door.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A mail slot receiving device and garage door combination comprising:

a track;

a garage door having a mail slot directed therethrough and being slidably mounted on the track so as to translate from a first position wherein the garage door is substantially vertically oriented to a second position wherein the garage door is substantially horizontally oriented;

a mounting means being secured to the garage door beneath the mail slot thereof; and, a flexible receiving means coupled to the mounting means for receiving mail positioned through the mail slot of garage door to retain the mail, such that when the garage door is raised into the second position, the receiving means is permitted to swing relative to the mounting means under an influence of gravity to preclude a gravitationally induced egress of mail from the receiving means;

wherein the mounting means comprises a frame mounted to the garage door, the frame of the mounting means including an inner frame member spaced from and oriented parallel to an outer frame member, with a pair of lateral frame members extending substantially orthogonally between respectively opposed pairs of ends of the inner and outer frame members to define a substantially rectangular shape of the frame, the inner frame member being a continuous member extending between inner ends of the lateral frame members, the inner frame member being positioned in an abutting orientation with an interior surface of the garage door beneath the mail slot thereof and the outer frame member being positioned in an orientation spaced from the interior surface of the garage door substantially a distance equal to a length of the lateral frame member, the inner frame member being fixedly secured to the interior surface of the garage door by a plurality of fasteners associated with the inner frame member and engaging the interior surface of the garage door, whereby the frame member remains fixedly secured to said garage door in either of the first position wherein the garage door is substantially vertically oriented and the second position wherein the garage door is substantially horizontally oriented.

2. The mail slot receiving device and garage door combination of claim 1, wherein the flexible receiving means comprises a mesh bag having an open upper end secured to the frame of the mounting means, and a closed lower end supporting mail positioned therein.

3. The mail slot receiving device and garage door combination of claim 2, wherein the mesh bag includes an inner mesh web spaced from an outer mesh web, a pair of lateral mesh webs coupled to respectively opposed pairs of edges of the inner and outer mesh webs to define the mesh bag, and a transverse bottom mesh web extending between the inner, outer, and lateral mesh webs.

* * * * *